US005820703A

United States Patent [19]

Suzuki et al.

[11] Patent Number: 5,820,703

[45] Date of Patent: Oct. 13, 1998

[54] PRODUCTION METHOD OF STEEL PIPE EXCELLENT IN CORROSION RESISTANCE AND WELDABILITY

[75] Inventors: Yasushi Suzuki; Masaaki Obata; Akihiro Miyasaka, all of Tokai, Japan

[73] Assignee: Nippon Steel Corporation, Tokyo, Japan

[21] Appl. No.: 750,758

[22] Filed: Dec. 13, 1996

[30] Foreign Application Priority Data

Jun. 16, 1994 [JP] Japan ..... 6-156494

[51] Int. Cl.[6] ..... C21D 8/10; C21D 9/08

[52] U.S. Cl. ..... 148/593; 219/608; 219/612

[58] Field of Search ..... 148/592, 593; 219/243, 612, 608, 61, 60.2

[56] References Cited

FOREIGN PATENT DOCUMENTS

| | | |
|---|---|---|
| 63-134630 | 6/1988 | Japan . |
| 63-213619 | 9/1988 | Japan . |
| 63-238217 | 10/1988 | Japan . |
| 4-99127 | 3/1992 | Japan . |
| 4-99128 | 3/1992 | Japan . |
| 4-191319 | 7/1992 | Japan . |
| 4-191320 | 7/1992 | Japan . |
| 5-156408 | 6/1993 | Japan . |
| 5-156409 | 6/1993 | Japan . |
| 5-263139 | 10/1993 | Japan . |

*Primary Examiner*—Deborah Yee
*Attorney, Agent, or Firm*—Kenyon & Kenyon

[57] ABSTRACT

A steel pipe having excellent corrosion resistance in an environment containing wet carbon dioxide and a small amount of hydrogen sulfide and having also excellent weldability is produced at a low production cost and with high productivity. The production method comprises heating to a temperature of 1,050° to 1,300° C. a slab containing, in terms of wt %, 0.01 to less than 1.2% of Si, 0.02 to 3.0% of Mn, 7.5 to 14.0% of Cr and 0.005 to 0.5% of Al, reduced C, N, P and S contents, at least one of Cu, Ni, Co, Mo and W, a balance of Fe and unavoidable impurities, and having an MC value of at least 0, finishing hot rolling within an austenite monophase temperature range, coiling the steel sheet as a hot coil having a sheet thickness of 3.0 to 25.4 mm, cooling the coil at a cooling rate of at least 0.01° C./sec to at least 500° C. to convert the steel sheet to a steel substantially consisting of martensite, reheating the steel to a temperature of 550° C. to not more than an $A_{c1}$ transformation point, holding it for at least 15 minutes, cooling the steel web to a normal temperature, cutting it into a predetermined width, and welding both ends of the steel by electric resistance welding while the steel coil is continuously shaped into a cylindrical shape.

20 Claims, No Drawings

PRODUCTION METHOD OF STEEL PIPE EXCELLENT IN CORROSION RESISTANCE AND WELDABILITY

TECHNICAL FIELD

This invention relates to a production method of a steel pipe excellent in corrosion resistance and weldability. More particularly, this invention relates to a method of producing easily and at a low cost a steel pipe which has a high corrosion resistance in an environment containing wet carbon dioxide and a small amount of wet hydrogen sulfide, has also excellent weldability and can be used as oil well pipes for the exploitation and production of petroleum/natural gases and line pipes for the transportation, for example.

BACKGROUND ART

Petroleum and natural gases produced in recent years have become more and more of the type which contains wet carbon dioxide and hydrogen sulfide. It is well known that under such an environment, carbon steels and low alloy steels corrode remarkably. To transport such corrosive petroleum and natural gases, it has been customary to add a corrosion inhibitor as an anticorrosion countermeasure. In the case of offshore oil wells, however, it is enormously expensive to add and recover the corrosion inhibitor, and the use of the corrosion inhibitor has become more and more difficult due to the problem of ocean pollution. For these reasons, recently, a need for corrosion-resistant materials which do not need the addition of a corrosion inhibitor has become greater.

As corrosion-resistant materials for petroleum and natural gases containing large quantities of carbon dioxide, the introduction of stainless steels has been examined. For example, as described in J. Klein "Corrosion", '84, Paper No. 211, a martensitic stainless steel containing about 0.2% of C and about 12 to 13% of Cr as typified by an AISI420 steel has been widely used. However, this steel involves the problem that the steel cannot be annealed at a high temperature to obtain a high strength necessary for using the steel as an oil well pipe, and thus its impact toughness is low. Since the AISI420 steel contains about 0.2% of C, its weldability is extremely poor. In other words, the hardness of the welding heat affected zone remarkably increases, a pre-heating temperature and a post-heating temperature for preventing weld crack are extremely high, and toughness of the welding heat affected zone is extremely low.

As described in Japanese Unexamined Patent Publication (Kokai) Nos. 63-134630 and 63-238217, for example, martensite steel oil well pipes typified by the AISI420 steel have been generally produced in the past as seamless steel pipes by a seamless steel pipe rolling method. However, the seamless steel pipes involve the problems that a production yield and productivity are extremely low and the production cost is extremely high. In the case of the martensitic stainless steel pipes produced by the seamless steel pipe production method, the steel pipe must be subjected to quenching and tempering heat-treatments after pipe making, and this is one of the causes for the high production cost of the seamless steel pipes. In the case of low carbon martensitic stainless steels which reduce as much as possible the C or C and N contents so as to improve the corrosion resistance or weldability, the steel pipes cannot be produced easily by the seamless steel pipe rolling method.

In contrast, Japanese Unexamined Patent Publications (Kokai) No. 4-191319 and No. 4-191320 disclose a method of producing a steel pipe from a low carbon martensitic stainless steel, and Japanese Unexamined Patent Publications (Kokai) No. 4-99127 and No. 4-99128 disclose a method of producing a low carbon martensitic stainless steel pipe. On the other hand, Japanese Unexamined Patent Publication (Kokai) No. 5-263139 describes a method of producing an oil well pipe containing 12 to 14 wt % of Cr as an electric resistance seam welded steel pipe. However, these methods require heat-treatment such as normalizing and tempering after the steel pipe is made, and involve the problems that the production cost is high, and oxide scales are formed on the steel pipe surface.

SUMMARY OF THE INVENTION

In view of the problems described above, the present invention aims at providing a method of easily producing, at a low cost, a steel pipe having excellent corrosion resistance in a carbon dioxide-containing environment, etc., and also having excellent weldability.

The gist of the present invention resides in the following points (1) to (7).

(1) A method for producing a steel pipe having excellent corrosion resistance and excellent weldability characterized in that a steel slab containing, in terms of percent by weight, 0.01% to less than 1.2% of Si, 0.02 to 3.0% of Mn, 7.5 to 14.0% of Cr, 0.005 to 0.5% of Al, reducing C to not more than 0.03%, N to not more than 0.02%, P to not more than 0.03% and S to not more than 0.01%, containing at least one of not more than 4.0% of Cu, not more than 4.0% of Ni, not more than 2.0% of Co, not more than 3.0% of Mo and not more than 3.0% of W, and the balance of Fe and unavoidable impurities, and having an MC value, given by the following formula, of at least 0, is shaped into a steel pipe by serially carrying out the following steps ① to ③:

$$MC\ \text{value}=80+420[\%C]+440[\%N]+30([\%Ni]+[\%Cu]+[\%Co])+15[\%Mn]-12([\%Si]+[\%Cr]+[\%Mo])-24[\%Nb]-48([\%V]+[\%Ti]+[\%Al])-6[\%W]$$

where [%X] represents the content of an element X expressed by wt %.

① a step of heating a steel slab to a temperature of 1,050° to 1,300° C., finishing hot rolling within a temperature range in which a metal structure remains substantially an austenite monophase, forming a hot coil having a sheet thickness of 3.0 mm to 25.4 mm, coiling it as the hot coil within a temperature range in which the metal structure remains substantially the austenite monophase, cooling the coil at a cooling rate of at least 0.01° C./sec to at least 500° C., and forming a steel the metal structure of which substantially comprises martensite;

② a step of reheating the hot coil described above to a temperature not less than 550° C. but not more than an $A_{c1}$ transformation point, holding it for at least 15 minutes and cooling the coil to room temperature;

③ a step of cutting the hot coil into a predetermined width, shaping continuously both of the steel edges into a cylindrical shape and seaming them by electric resistance welding to produce a seam welded steel pipe.

(2) A method for producing a steel pipe having excellent corrosion resistance and excellent weldability according to the item (1), wherein the steel slab contains, in terms of percent by weight, not more than 1.0% in total of at least one of Nb, V and Ti as additional components.

(3) A method for producing a steel pipe having excellent corrosion resistance and excellent weldability according to the item (1) or (2), wherein C contents of the steel slab is reduced to not more than 0.015% and N is reduced to not more than 0.015% in terms of percent by weight, and the total of C and N is reduced to not more than 0.02%.

(4) A method for producing a steel pipe having excellent corrosion resistance and excellent weldability according to any of the items (1) to (3), wherein the steel slab contains, in terms of percent by weight, at least one of not more than 0.05% of rare earth elements and not more than 0.03% of Ca.

(5) A method for producing a steel pipe having excellent corrosion resistance and excellent weldability according to any of the items (1) to (4), wherein the pipe is produced by electric resistance seam welding, and after the temperature of the seam welded portion drops below an Ms point, at least the seam welded portion and portions within 2 mm on both sides of the seam welded portion are reheated to a temperature not less than 550° C. but not more than an $A_{c1}$ transformation point and are then cooled.

(6) A method for producing a steel pipe having excellent corrosion resistance and excellent weldability according to any of the items (1) to (4), wherein the pipe is produced by electric resistance seam welding, after the temperature of the seam welded portion and portions within 2 mm on both sides of the seam welded portion are reheated again to a temperature not less than (an $A_{c3}$ transformation point +50° C.), they are cooled rapidly to a temperature lower than an Ms point, and at least the seam welded portion and the portions within 2 mm on both sides of the seam welded portion are again reheated to a temperature not less than 550° C. and not more than an $A_{c1}$ transformation point and are then cooled.

(7) A method for producing a steel pipe having excellent corrosion resistance and excellent weldability according to the item (5) or (6), wherein, when at least the seam welded portion and portions within 2 mm on both sides of the seam welded portion are reheated to a temperature of not less than 550° C. and not more than the $A_{c1}$ transformation point and are then cooled, the full-body of the steel pipe is reheated.

THE BEST MODE FOR CARRYING OUT THE INVENTION

The present invention solves the various problems with the martensitic stainless steels typified by the stainless steel AISI420 steel that have been examined in the past as the corrosion-resistant materials for petroleum and natural gases containing large quantities of carbon dioxide, and is directed to make it possible particularly to secure a high strength necessary for line pipes and oil well pipes, to restrict the rise of the hardness of the welding heat affected zone and to improve the corrosion resistance and weldability.

To accomplish the objects described above, the present invention limits the range of the chemical compositions of the steel from the aspect of the corrosion resistance and weldability, and optimizes a hot working condition of a raw steel sheet rolling process and a pipe making process and a cooling condition after hot working.

Hereinafter, the reasons for limitation of the production condition of the steel pipe having excellent corrosion resistance and weldability according to the present invention will be explained. First, the reason for limitation of each chemical composition will be explained. The term "%" represents "wt %" unless specified otherwise.

Si

The addition of Si as a deoxidizing agent and a strengthening element to a steel containing 7.5 to 14.0% of Cr is effective. However, if the Si content is less than 0.01%, the deoxidizing effect is not sufficient and if it exceeds 1.2%, the effect gets into saturation and moreover, impact toughness and electric resistance seam weldability drop. Therefore, the Si content is limited to the range of 0.01% to less than 1.2%. Furthermore, when the necessary strength can be obtained by the combination of other alloy elements and the production condition, a large quantity of Si need not be added, and the Si addition quantity is reduced preferably to not more than 0.2% as the necessary and sufficient amount for deoxidation.

Mn

Mn is necessary as the deoxidizing agent for a steel containing 7.5 to 14.0% of Cr, and at least 0.02% of Mn must be added. Mn is also a useful element for converting the metallic structure to the structure mainly consisting of martensite. If the Mn content exceeds 3.0%, however, the effect of addition gets into saturation, and the excessive Mn content induces difficulties in steel making. Therefore, the upper limit of the Mn content is limited to 3.0%.

Cr

In order to secure the high corrosion resistance and high strength as the object of the present invention, at least 7.5% of Cr must be contained. If the Cr content exceeds 14.0%, however, large quantities of alloy elements must be added so as to obtain the metallic structure mainly consisting of martensite, and this not only increases the production cost but also invites difficulties in the heat-treatment of the hot coil. Therefore, the Cr content is limited to 7.5 to 14.0%.

Al

At least 0.005% of Al must be added as the deoxidizing agent. When Al is added in the amount exceeding 0.5%, however, coarse oxide type inclusions are formed and invite a deterioration in the stress corrosion cracking resistance. Therefore, the upper limit of the Al content is set to 0.5%.

C:

C forms carbides with Cr, lowers the toughness and the corrosion resistance and remarkably raises the hardness of the welding heat affected zone. Therefore, the C content is limited to not greater than 0.03%.

N:

N lowers the toughness of the weld portion and remarkably raises the hardness of the welding heat affected zone. Therefore, the N content is limited to not more than 0.02%.

Furthermore, when the hardness of the welding heat affected zone must be lowered and weldability must be improved particularly when the steel is shaped into the line pipe, etc., the C content must be limited to not more than 0.015% and the N content, to not more than 0.015%, and the total content of (C+N) is preferably limited to not more than 0.02%.

P

A large amount of P content lowers the toughness. Therefore, the P content must be reduced to not more than 0.03%, and the P content is preferably as little as possible.

S

A large amount of S content, too, lowers hot workability, ductility and corrosion resistance. Therefore, the S content is preferably less, and must be limited to not more than, 0.01%.

Cu, Ni and Co

When added to a steel containing 7.5 to 14.0% of Cr, Cu, Ni and Co remarkably improve the corrosion resistance, and they are necessary and useful elements for forming the metallic structure mainly consisting of martensite. However, even when Cu and Ni are added in the amount more than 4.0%, and Co in the amount more than 2.0%, the effect of addition gets into saturation, and the addition in such amounts not only makes heat-treatment of the hot coil difficult but merely increases the production cost. On the other hand, the lower limit of the addition of Cu, Ni and Co is associated with the amount of addition of other alloy elements, and must be selected so that an MC value becomes at least 0.

Mo and W

When added to a steel containing 7.5 to 14.0% of Cr, Mo and W are effective for improving the corrosion resistance in a wet carbon dioxide gas environment. In any way, the effect of the addition gets into saturation when they are added in the amount exceeding 3.0%. Further, because large quantities of other alloy elements such as Cu, Ni, Co, etc., must be added so as to form the metallic structure mainly consisting of martensite, heat-treatment of the hot coil becomes difficult. Therefore, the upper limit of each of Mo and W is set to 3.0%.

In the present invention, the MC value defined by the following formula as the combination of the content of each element must be at least 0:

$$MC\ \text{value}=80+420[\%C]+440[\%N]+30([\%Ni]+[\%Cu]+[\%Co])+15[\%Mn]-12([\%Si]+[\%Cr]+[\%Mo])-24[\%Nb]-48([\%V]+[\%Ti]+[\%Al])-6[\%W]$$

where [%X] represents the content of an element X in terms of wt %.

When this MC value is less than 0, it is difficult to form the metallic structure consisting substantially of martensite whichever hot-rolling condition and heat-treatment condition may be selected, and the strength and toughness as the indispensable characteristics for the oil well pipe or the line pipe drop. When the MC value is less than 0, further, it becomes difficult to stably form the austenite structure in the hot rolling temperature zone, the possibility of the occurrence of large rolling scratches becomes high, and the production yield drops. Therefore, the MC value must be at least 0. When the MC value is at least 0, a steel, the metallic structure of which substantially consists of martensite, can be obtained by the combination of the later-appearing rolling condition, coiling condition and cooling condition.

The elements described above are the basic components of the steel to which the present invention is directed, but the following elements may be added, whenever necessary, so as to further improve the steel characteristics.

Nb, V and Ti

When added to a steel containing 7.5 to 14.0% of Cr, Nb, V and Ti provide a great effect of reducing the hardness of the welding heat affected zone, and also improve the corrosion resistance. However, when they are added in excessive amounts, the effect of addition gets into saturation and the toughness of the base metal drops. Therefore, the sum of at least one of Nb, V and Ti must not exceed 1.0%. Particularly when an excellent toughness of the base metal is required, the sum of at least one of Nb, V and Ti does not preferably exceed 0.5%. On the other hand, in order to sufficiently lower the hardness of the welding heat affected zone, the sum of at least one of Nb, V and Ti is preferably at least 0.1%.

Rare earth elements (REM) and Ca

Rare earth elements and Ca are elements which are effective for improving hot workability and impact toughness. However, when the rare earth elements in an amount more than 0.05% and Ca in an amount more than 0.03% are added, coarse non-metallic inclusions of these elements are formed, respectively, and hot workability and corrosion resistance are deteriorated. Therefore, the upper limit is 0.05% for the rare earth elements and 0.03% for Ca. The term "rare earth elements" used in this specification represents the elements having the atomic numbers of 57 to 71, 89 to 103 and Y.

The steel used for the method of the present invention may contain Zr, B, etc., as mixed impurities from scraps or those added for adjusting toughness, workability, but in such a case, too, the MC value described above must be at least 0. Though the oxygen content is not particularly limited in the present invention, the oxygen content is preferably as small as possible because oxygen is an impurity which forms oxide type non-metallic inclusions.

Next, the production steps of the present invention and the reasons for limitation will be explained.

Slab Heating Temperature

Hot workability in hot rolling must be secured by uniformly heating the slab to its center portion. However, if heating is made to a temperature more than 1,300° C., the material loss due to the formation of oxide scales becomes so remarkable that the production yield drops. When the heating temperature is less than 1,050° C., on the other hand, the deformation resistance in hot rolling becomes excessively great. Therefore, the slab heating temperature is limited to 1,050° to 1,300° C.

Hot Rolling

Ordinary hot coil rolling can be employed for hot rolling. The sheet thickness is limited to at least 3.0 mm to not more than 25.4 mm from practical utility of the sheet for the oil well pipe or the line pipe. From the aspect of productivity in subsequent seam welding, the shape of the sheet is limited to the hot coil.

Rolling Finish Temperature and Coiling Temperature

When the hot coil is coiled after hot rolling, it is necessary to finish hot rolling and coiling within the temperature range in which the metallic structure substantially remains the austenite monophase in order to obtain a steel, the metallic structure of which substantially comprises martensite, during the cooling process after coiling. If austenite undergoes transformation to ferrite partially or wholely before coiling, the toughness of the base metal of the steel becomes poor. If austenite undergoes transformation to martensite partially or wholely before coiling, the strength of the steel rises, so that coiling becomes difficult. Incidentally, there is the case in hot rolling where ferrite transformation is promoted by working and for this reason, hot rolling and coiling must be finished at a temperature at which the austenite monophase structure can be secured even when hot working is carried out. When the metallic structure substantially comprises the austenite monophase, there are no other limitations to the hot rolling finish temperature and to the coiling temperature. If the temperature is too low, however, the hot rolling deformation resistance becomes great even though the structure is the austenite monophase structure. Therefore, a suitable temperature must be set within the range of the capacity of the hot rolling mill and that of the coiling machine.

Cooling Condition

When the hot coil after coiling is cooled, cooling must be carried out at a cooling rate of at least 0.01° C./sec to a temperature of 500° C. or lower. This is for preventing the formation of ferrite from austenite and converting the steel to one whose metallic structure substantially comprises martensite after cooling. If the cooling rate is less than 0.01° C./sec, the possibility that ferrite is formed during cooling becomes high. In the steel to which the present invention is directed, on the other hand, austenite cooled to less than 500° C. no longer undergoes transformation to ferrite, and because the cooling rate at a temperature less than 500° C. has small influences on the martensite transformation, any cooling rate may be used at a temperature less than 500° C.

Reheating of Hot Coil

In order to obtain a suitable strength after pipe-making of the steel pipe and to secure a toughness, the heating temperature of less than 550° C. or the holding time of less than 15 minutes is not preferable because the toughness of the base metal is not sufficient. When the heating temperature exceeds the $A_{c1}$ transformation point, fresh martensite is formed in subsequent cooling process and the toughness as well as the stress corrosion cracking resistance of the base metal drop. Provided that the holding time of at least 15 minutes is secured, a longer holding time causes no problem. When box annealing is employed, the holding time is from about 2 to about 10 hours. The reheating atmosphere may be the air atmosphere, but is more preferably a non-oxidizing atmosphere or a reducing atmosphere in order to reduce the oxide scales on the steel surface and to improve the production yield of the steel pipe without lowering the corrosion resistance. For example, it is preferred to use a mixed gas consisting of 5 to 15% of hydrogen and the balance of a nitrogen or argon gas.

Forming & Electric Resistance Seam Welding

An ordinary production process of an electric resistance seam welded steel pipe can be employed for forming and seam welding in the present invention, and a seam welded steel pipe is produced by cutting a steel coil into a predetermined width in accordance with a required outer diameter as an oil well pipe or a line pipe and welding both edges of the steel coil by electric resistance welding while continuously shaping the steel coil so cut into a cylindrical shape.

In the present invention, besides the production steps described above, the steps of producing the steel pipe by seam welding, reheating the seam welded portion and the portions within 2 mm from both sides of the seam to a temperature of not less than 550° C. and not more than the $A_{c1}$ transformation point and then cooling the pipe may be added, whenever necessary. The object of this additional production step is to lower the hardness of the hardened structure formed locally at the time of seam welding and to improve the toughness of the seam welded portion. When reheating is carried out, only the portions in the proximity of the seam welded portion may be reheated immediately after seam welding by using a post annealer, for example, or the full-body of the steel pipe may be heated.

In addition to the production steps described above, it is further possible in the present invention to add the steps of reheating the seam welded portion and the portions within at least 2 mm from both sides of the seam welded portion to not less than the $A_{c3}$ transformation point +50° C., rapidly cooling them to a temperature below an Ms point, further heating again at least the seam welded portion and the portions within 2 mm from both sides of the seam to a temperature from 550° C. to the $A_{c1}$ transformation point and then cooling them. The object of the additional steps is to reduce non-uniformity occurring at the time of seam welding and to further improve the toughness of the seam welded portion. When the seam welded portion and the portions within at least 2 mm from both sides of the seam are heated to not less than the $A_{c3}$ transformation point +50° C., it is preferred to reheat only the portions in the proximity of the seam welded portion immediately after seam welding by using the post-annealer. The steel pipe may be naturally heated as a whole, but in this case, the steel pipe is hardened as a whole, so that the material property secured at the time of the hot coil is lost. After reheating is made to the $A_{c3}$ transformation point +50° C. or more, the pipe must be rapidly cooled to a temperature lower than the Ms point. For, if reheating is made before the temperature goes down to the Ms point, the effect of reheating cannot be obtained even when reheating is made to the temperature from 550° C. to the $A_{c1}$ transformation point. Particularly when an in-line continuous processing is carried out by using the post annealer, rapid cooling is essentially necessary. On the other hand, when at least the seam welded portion and the portions within 2 mm from both sides of the seam are reheated to a temperature of 550° C. to the $A_{c1}$ transformation point, only the portions in the proximity of the seam welded portion may be reheated immediately after seam welding by using the post annealer, or the steel pipe may be heated as a whole.

In the present invention, the metallic structure of the hot coil of the steel having the selected components is converted to the structure substantially consisting of tempered martensite. If the structure of the hot coil remains un-tempered martensite, the strength is excessively high and hence, workability and toughness are extremely inferior. In contrast, workability of the steel can be improved by tempering the mertensite under the state of the hot coil so as to provide a suitable strength to the hot coil, and forming in the production of the seam welded steel pipe can be attained with a remarkable increase in productivity.

Since the metallic structure is converted to the tempered martensite, a high strength such as a yield strength of at least 551 MPa, for example, can be easily obtained, and a high strength and an excellent impact toughness can be obtained, too.

EXAMPLES

Hereinafter, Examples of the present invention will be explained.

Steels having the components tabulated in Table 1 were melted, and hot coils each having a sheet thickness of 11 mm were produced by ordinary hot rolling processes under the conditions tabulated in Table 2. Further, each coil was shaped into a seam welded steel pipe having an outer diameter of 273 mm by a seam welded steel pipe line, and having a yield strength of at least 448 N/mm$^2$. The slab heating temperature in hot rolling was 1,230° C. Comparative Example 16 corresponded to an AISI420 steel. In each of the steel pipes, pipe heat-treatment such as quenching or normalizing was not done after pipe making.

TABLE 1

| | | Chemical Compositions (wt %) | | | | | | | | | | | | | | MC |
|---|---|---|---|---|---|---|---|---|---|---|---|---|---|---|---|---|
| | | C | Si | Mn | P | S | Cr | Al | Ni | Cu | Co | Mo | W | N | others | Value |
| Examples of | 1 | 0.010 | 0.35 | 0.66 | 0.013 | 0.002 | 12.18 | 0.07 | 2.15 | — | — | — | — | 0.006 | | 7.52 |
| This | 2 | 0.007 | 0.33 | 0.79 | 0.013 | 0.002 | 11.87 | 0.03 | 1.88 | 0.51 | — | — | — | 0.006 | | 21.29 |
| Invention | 3 | 0.011 | 0.16 | 0.61 | 0.021 | 0.003 | 12.95 | 0.12 | 2.53 | — | — | — | — | 0.007 | | 9.67 |
| | 4 | 0.008 | 0.17 | 0.58 | 0.010 | 0.003 | 12.03 | 0.04 | 2.04 | — | 0.31 | — | — | 0.010 | Ti 0.15 | 11.44 |
| | 5 | 0.010 | 0.10 | 1.55 | 0.010 | 0.002 | 13.25 | 0.04 | 1.33 | 1.55 | 0.48 | — | — | 0.012 | | 51.40 |

TABLE 1-continued

| | | Chemical Compositions (wt %) | | | | | | | | | | | | | | MC |
|---|---|---|---|---|---|---|---|---|---|---|---|---|---|---|---|---|
| | | C | Si | Mn | P | S | Cr | Al | Ni | Cu | Co | Mo | W | N | others | Value |
| | 6 | 0.005 | 0.11 | 0.15 | 0.011 | 0.004 | 12.11 | 0.04 | 1.97 | 1.91 | 0.34 | — | — | 0.008 | | 65.91 |
| | 7 | 0.008 | 0.12 | 0.49 | 0.010 | 0.002 | 9.03 | 0.06 | 2.02 | 0.75 | 0.52 | 1.53 | — | 0.008 | | 61.89 |
| | 8 | 0.007 | 0.12 | 0.48 | 0.005 | 0.002 | 8.54 | 0.03 | 1.17 | 0.77 | 0.88 | — | — | 0.007 | Nb 0.21 V 0.07 | 64.06 |
| | 9 | 0.008 | 0.21 | 0.52 | 0.007 | 0.001 | 12.22 | 0.09 | 2.16 | 0.77 | — | 0.53 | 1.10 | 0.005 | | 21.42 |
| | 10 | 0.012 | 0.21 | 0.13 | 0.015 | 0.001 | 12.06 | 0.10 | 0.99 | 2.53 | — | 0.49 | — | 0.010 | | 39.07 |
| | 11 | 0.009 | 0.10 | 0.52 | 0.014 | 0.001 | 11.53 | 0.02 | 1.94 | 0.33 | 0.20 | 0.94 | — | 0.009 | Nb 0.11 Ti 0.10 | 10.40 |
| | 12 | 0.006 | 0.12 | 0.33 | 0.015 | 0.002 | 11.90 | 0.03 | 2.31 | — | — | 0.61 | 0.33 | 0.008 | Ca 0.005 | 7.29 |
| Comparative | 13 | 0.057 | 0.32 | 0.26 | 0.013 | 0.005 | 12.51 | 0.06 | — | — | — | — | — | 0.024 | | −38.44 |
| Examples | 14 | 0.011 | 0.33 | 0.48 | 0.011 | 0.004 | 11.99 | 0.22 | — | — | — | 0.52 | — | 0.011 | Nb 0.14 | −71.34 |
| | 15 | 0.011 | 0.28 | 0.22 | 0.009 | 0.004 | 4.55 | 0.05 | 1.56 | 0.58 | — | — | 0.22 | 0.018 | | 99.68 |
| | 16 | 0.180 | 0.36 | 0.48 | 0.018 | 0.002 | 12.33 | 0.05 | 0.36 | — | — | — | — | 0.015 | | 25.52 |
| | 17 | 0.016 | 0.30 | 0.41 | 0.015 | 0.004 | 12.24 | 0.05 | 2.30 | 0.55 | — | — | — | 0.008 | | 29.01 |

MC value = 80 + 420[% C] + 440[% N] + 30([% Ni] + [% Cu] + [% Co]) + 15[% Mn] − 12([% Si] + [% Cr] + [% Mo]) − 24 [% Nb] − 48([% V] + [% Ti] + [% Al]) − 6[% W]

TABLE 2

| | | Rolling Finish (°C.) | Coiling Temp. (°C.) | Cooling Rate down to 500° C. (°C./sec) | Reheat-Treatment Condition of Hot Coil | Heat-treatment after Electric Resistance Seam Welding | Corrosion Resistance | Max. Hardness of Welding Heat Affected Zone | Impact Toughness Base Metal | Impact Toughness Welding Heat Affected Zone |
|---|---|---|---|---|---|---|---|---|---|---|
| Examples of | 1 | 850 | 780 | 0.03 | 650° C. × 4 h | seam annealer, 670° C. | ○ | ○ | ○ | ○ |
| This | 2 | 860 | 810 | 0.02 | 660° C. × 5 h | seam annealer, 670° C. | ○ | ○ | ○ | ○ |
| Invention | 3 | 850 | 780 | 0.1 | 640° C. × 2.5 h | seam annealer, 660° C. | ○ | ○ | ○ | ○ |
| | 4 | 860 | 800 | 0.1 | 660° C. × 4 h | full body, 690° C. | ○ | ○ | ○ | ○ |
| | 5 | 850 | 790 | 0.05 | 680° C. × 4 h | seam annealer, 690° C. | ○ | ○ | ○ | ○ |
| | 6 | 850 | 800 | 0.02 | 650° C. × 5 h | nil | ◎ | ○ | ○ | ○ |
| | 7 | 850 | 800 | 0.02 | 640° C. × 5 h | seam annealer, 670° C. | ◎ | ○ | ○ | ○ |
| | 8 | 850 | 800 | 0.02 | 620° C. × 4 h | seam annealer, 700° C. | ○ | ○ | ○ | ○ |
| | 9 | 860 | 800 | 0.03 | 620° C. × 5 h | After portions near seam welded portion were heated to 880° C. and rapidly cooled only portions near seam welded portion were heated to 640° C. | ○ | ○ | ○ | ○ |
| | 10 | 900 | 850 | 0.1 | 680° C. × 2 h | seam annealer, 700° C. | ◎ | ○ | ○ | ○ |
| | 11 | 880 | 830 | 0.03 | 650° C. × 2 h | seam annealer, 670° C. | ◎ | ○ | ○ | ○ |
| | 12 | 900 | 850 | 0.02 | 640° C. × 3 h | nil | ○ | ○ | ○ | ○ |
| Comparative | 13 | 850 | 780 | 0.05 | 640° C. × 3 h | nil | x | x | x | xx |
| Examples | 14 | 880 | 820 | 0.005 | 620° C. × 4 h | seam annealer, 660° C. | ○ | ○ | x | xx |
| | 15 | 800 | 760 | 0.2 | 650° C. × 4 h | seam annealer, 670° C. | xx | ○ | ○ | x |
| | 16 | 880 | 820 | 0.03 | 650° C. × 3 h | seam annealer, 700° C. | xx | xx | xx | xx |
| | 17 | 880 | 820 | 0.03 | nil | seam annealer, 650° C. | ○ | ○ | x | x |

Next, these steel pipes were welded to form weld joints by manual are welding as welding corresponding to on-site circumferential welding at the time of lay-down of a line pipe. Welding heat input was 17 kJ/cm. JIS No. 4 impact testpieces (full size) were sampled from the base metal and the heat affected zones of the weld portions, and impact tests were carried out. Maximum hardness of the welding heat affected zones was measured as a Vickers' hardness at a 1 kg load. On the other hand, a testpiece was sampled from the base metal of each steel pipe, and a corrosion test in a wet carbon dioxide environment was carried out. Each testpiece having a thickness of 3 mm, a width of 15 mm and a length of 50 mm was used for the wet carbon dioxide environment, and was immersed in a 5% aqueous NaCl solution inside an autoclave at a testing temperature of 120° C. at a carbon dioxide pressure of 40 atms for 30 days. A corrosion rate was calculated from the weight change between the weight before the test and the weight after the test. The unit of this corrosion rate was expressed by mm/y. It is generally believed that if a corrosion rate of a certain material in a certain environment is less than 0.1 mm/y, the material is sufficiently anti-corrosive and can be used.

The test results are also tabulated in Table 2. In the impact test result shown in Table 2, symbol ○ shows that a fracture appearance transition temperature is not more than −30° C., symbol x shows that the fracture appearance transition temperature is from −30° C. to 0° C., and symbol xx shows that the fracture appearance transition temperature exceeds 0° C. In the maximum hardness of the welding heated affected zones shown in Table 2, symbol ○ shows the maximum hardness is less than 300, x shows that it is from 300 to less than 450 and symbol xx shows that it is at least 450. In the corrosion test result shown in Table 2, symbol ⊚ shows that the corrosion rate is less than 0.05 mm/y, symbol ○ shows that it is from 0.05 to less than 0.10 mm/y, symbol x shows that it is 0.1 to less than 0.5 mm/y, and symbol xx shows that it is at least 0.5 mm/y.

It can be clearly appreciated from Table 2 that, in Examples Nos. 1 to 12 according to the present invention, the impact toughness of the base metal and the welding heat affected zone was excellent, the maximum hardness of the welding heat affected zone was low, and the materials exhibited the excellent corrosion resistance and weldability. In other words, the steel pipes having excellent characteristics could be produced at a low cost of production and with high productivity without applying heat-treatment such as quenching-tempering or normalizing-tempering. The reason why the steel pipes of the present invention has excellent corrosion resistance in the carbon dioxide environment is because it contains 7.5 to 14.0% of Cr, and Cu or Ni, and moreover, because the invention restricts C to not more than 0.03% and N to not more than 0.02%. In contrast, since Comparative Examples Nos. 13 to 17 did not satisfy the requirements for the component composition, or their production conditions were not suitable, the characteristics of all of the Comparative Examples were inferior.

As described above, the present invention can produce, at a low cost and with high productivity, steel pipes excellent in both corrosion resistance and weldability.

We claim:

1. A method for producing a steel pipe having excellent corrosion resistance and excellent weldability comprising carrying out serially the following steps ① to ③ to produce a steel pipe by using a slab which contains, in terms of percent by weight:

Si: 0.01 to less than 1.2%,

Mn: 0.02 to 3.0%

Cr: 7.5 to 14.0%, and

Al: 0.005 to 0.5%;

which reduces the following components:

C: to not more than 0.03%,

N: to not more than 0.02%,

P: to not more than 0.03%, and

S: to not more than 0.01%;

which further contains at least one of the following components:

Cu: not more than 4.0%,

Ni: not more than 4.0%,

Co: not more than 2.0%,

Mo: not more than 3.0%, and

W: not more than 3.0%;

the balance of which consists of Fe and unavoidable impurities; and which has an MC value, given by the following formula, of at least 0:

① heating said slab to a temperature of 1,050° to 1,300° C., finishing hot rolling within a temperature range in which a metallic structure substantially consists of an austenite monophase to convert the rolled sheet to a hot coil having a sheet thickness of 3.0 to 25.4 mm, coiling it as the hot coil within a temperature range in which the metallic structure substantially remains the austenite monophase, and cooling the coil at a cooling rate of at least 0.02° C./sec to at least 500° C. to obtain a steel the metallic structure of which substantially consists of martensite;

② reheating the hot coil to a temperature of not less than 550° C. to an $A_{C1}$ transformation point, holding it for at least 15 minutes and then cooling it to a room temperature; and ③ cutting the hot coil into a selected width, continuously forming it into a cylindrical shape and welding both end of the steel coil by electric resistance welding to obtain seam welded steel pipe:

$$MC\ \text{value}=80+420[\%C]+440[\%N]+30([\%Ni]+[\%Cu]+[\%Co])+15[\%Mn]-12([\%Si]+[\%Cr]+[\%Mo])-24[\%Nb]-48([\%V]+[\%Ti]+[\%Al])-6[\%W]$$

where [%X] represents the content of an element X in terms of wt %.

2. A method for producing a steel pipe having excellent corrosion resistance and excellent weldability according to claim 1, wherein said slab contains, in terms of percent by weight, not more than 1.0% in total of at least one of Nb, V and Ti as additional components.

3. A method for producing a steel pipe having excellent corrosion resistance and excellent weldability according to claim 1, wherein the C and N contents in said slab is reduced as follows:

C: to not more than 0.015%, and

N: to not more than 0.015%, and the total of C and N is not more than 0.02%.

4. A method for producing a steel pipe having excellent corrosion resistance and excellent weldability according to claim 1, wherein said slab contains, in terms of percent by weight, the following components as additional components:

rare each element: not more than 0.05%, and

Ca: not more than 0.03%.

5. A method for producing a steel pipe having excellent corrosion resistance and excellent weldability according to claim 1 further comprising:

using electric resistance seam welding for making the steel pipe, said steel pipe thereby having a seam welded portion;

cooling the seam welded portion to a temperature not higher than an Ms point;

reheating at least the seam welded portion and portions within 2 mm from both sides of the seam welded portion to a temperature of from 550° C. to $A_{C1}$ transformation point; and then cooling said reheated portions.

6. A method for producing a steel pipe having excellent corrosion resistance and excellent weldability according to claim 1 further comprising:

using electric resistance seam welding for making the steel pipe, said steel pipe thereby having a seam welded portion;

first reheating at least the seam welded portion and portions within 2 mm from both sides of the seam welded portion to a temperature not less than ($A_{C3}$ transformation point+50° C.);

rapidly cooling said first reheated portions to a temperature not more than an Ms point;

after said rapid cooling, second reheating of at least the seam welded portion and portions within 2 mm from both sides of the seam welded portion to a temperature of from 550° C. to not more than $A_{C1}$ transformation point; and then cooling said second reheated portions.

7. A method for producing a steel pipe having excellent corrosion resistance and excellent weldability according to claim 5 wherein said reheating step comprises reheating said pipe as a whole to a temperature of from 550° C. to not more than $A_{C1}$ transformation point.

8. A method for producing a steel pipe having excellent corrosion resistance and excellent weldability according to claim 6 wherein said second reheating step comprises reheating said pipe as a whole to a temperature of from 550° C. to not more than $A_{C1}$ transformation point.

9. A method for producing a steel pipe having excellent corrosion resistance and excellent weldability according to claim 2 further comprising:

using electric resistance seam welding for making the steel pipe, said steel pipe thereby having a seam welded cooling the seam welded portion to a temperature not higher than an Ms point;

reheating at least the seam welded portion and portions within 2 mm from both sides of the seam welded portion to a temperature of from 550° C. to $A_{C1}$ transformation point; and then cooling said reheated portions.

10. A method for producing a steel pipe having excellent corrosion resistance and excellent weldability according to claim 2 further comprising:

using electric resistance seam welding for making the steel pipe, said steel pipe thereby having a seam welded portion;

first reheating at least the seam welded portion and portions within 2 mm from both sides of the seam welded portion to a temperature not less than ($A_{C3}$ transformation point+50° C.);

rapidly cooling said first reheated portions to a temperature not more than an Ms point;

after said rapid cooling, second reheating of at least the seam welded portion and portions within 2 mm from both sides of the seam welded portion to a temperature of from 550° C. to not more than $A_{C1}$ transformation point; and then cooling said second reheated portions.

11. A method for producing a steel pipe having excellent corrosion resistance and excellent weldability according to claim 9 wherein said reheating step comprises reheating said pipe as a whole to a temperature of from 550° C. to not more than $A_{C1}$ transformation point.

12. A method for producing a steel pipe having excellent corrosion resistance and excellent weldability according to claim 10 wherein said second reheating step comprises reheating said pipe as a whole to a temperature of from 550° C. to not more than $A_{C1}$ transformation point.

13. A method for producing a steel pipe having excellent corrosion resistance and excellent weldability according to claim 3 further comprising:

using electric resistance seam welding for making the steel pipe, said steel pipe thereby having a seam welded portion;

cooling the seam welded portion to a temperature not higher than an Ms point;

reheating at least the seam welded portion and portions within 2 mm from both sides of the seam welded portion to a temperature of from 550° C. to $A_{C1}$ transformation point; and then cooling said reheated portions.

14. A method for producing a steel pipe having excellent corrosion resistance and excellent weldability according to claim 3 further comprising:

using electric resistance seam welding for making the steel pipe, said steel pipe thereby having a seam welded portion;

first reheating at least the seam welded portion and portions within 2 mm from both sides of the seam welded portion to a temperature not less than ($A_{C3}$ transformation point+50° C.);

rapidly cooling said first reheated portions to a temperature not more than an Ms point;

after said rapid cooling, second reheating of at least the seam welded portion and portions within 2 mm from both sides of the seam welded portion to a temperature of from 550° C. to not more than $A_{C1}$ transformation point; and then cooling said second reheated portions.

15. A method for producing a steel pipe having excellent corrosion resistance and excellent weldability according to claim 13 wherein said reheating step comprises reheating said pipe as a.whole to a temperature of from 550° C. to not more than $A_{C1}$ transformation point.

16. A method for producing a steel pipe having excellent corrosion resistance and excellent weldability according to claim 14 wherein said second reheating step comprises reheating said pipe as a whole to a temperature of from 550° C. to not more than $A_{C1}$ transformation point.

17. A method for producing a steel pipe having excellent corrosion resistance and excellent weldability according to claim 4 further comprising:

using electric resistance seam welding for making the steel pipe, said steel pipe thereby having a seam welded portion;

cooling the seam welded portion to a temperature not higher than an Ms point;

reheating at least the seam welded portion and portions within 2 mm from both sides of the seam welded portion to a temperature of from 550° C. to $A_{C1}$ transformation point; and then cooling said reheated portions.

18. A method for producing a steel pipe having excellent corrosion resistance and excellent weldability according to claim 4 further comprising:

using electric resistance seam welding for making the steel pipe, said steel pipe thereby having a seam welded portion;

first reheating at least the seam welded portion and portions within 2 mm from both sides of the seam welded portion to a temperature not less than ($A_{C3}$ transformation point+50° C.);

rapidly cooling said first reheated portions to a temperature not more than an Ms point;

after said rapid cooling, second reheating of at least the seam welded portion and portions within 2 mm from both sides of the seam welded portion to a temperature of from 550° C. to not more than $A_{C1}$ transformation point; and then cooling said second reheated portions.

19. A method for producing a steel pipe having excellent corrosion resistance and excellent weldability according to claim 17 wherein said reheating step comprises reheating said pipe as a whole to a temperature of from 550° C. to not more than $A_{C1}$ transformation point.

20. A method for producing a steel pipe having excellent corrosion resistance and excellent weldability according to claim 18 wherein said second reheating step comprises reheating said pipe as a whole to a temperature of from 550° C. to not more than $A_{C1}$ transformation point.

* * * * *

UNITED STATES PATENT AND TRADEMARK OFFICE

CERTIFICATE OF CORRECTION

PATENT NO. : 5,820,703

DATED : October 13, 1998

INVENTOR(S) : Yasushi SUZUKI, et al.

It is certified that error appears in the above-identified patent and that said Letters Patent is hereby corrected as shown below:

On the title page, underneath "Appl. No." and "Filed", please add PCT application number --PCT/JP95/01207-- and PCT filing date, --June 16, 1995--.

Column 3, line 62, change "Si" to --Si:--.

Column 4, line 9, change "Mn" to --Mn:--.

Column 4, line 19, change "Cr" to --Cr:--.

Column 4, line 1, change "Al" to --Al:--.

Column 4, line 5, change "P" to --P:--.

Column 4, line 56, change "S" to --S:--.

Column 4, line 60, change "Co" to --Co:--.

Column 5, line 7, change "W" to --W:--.

Column 5, line 45, change "Ti" to --Ti:--.

Column 5, line 59, change "Ca" to --Ca:--.

Column 6, line 13, change "Temperature" to --Temperature:--.

UNITED STATES PATENT AND TRADEMARK OFFICE

CERTIFICATE OF CORRECTION

PATENT NO. : 5,820,703

DATED : October 13, 1998

INVENTOR(S) : Yasushi SUZUKI, et al.

It is certified that error appears in the above-identified patent and that said Letters Patent is hereby corrected as shown below:

Column 6, line 23, change "Rolling" to --Rolling:--.

Column 6, line 30, change "Temperature" to --Temperature:--.

Column 6, line 54, change "Condition" to --Condition:--.

Column 7, line 1, change "Coil" to --Coil:--.

Column 7, line 20, change "Welding" to --Welding:--.

Column 12, line 24, delete the comma after "1" and insert --or 2,--.

Signed and Sealed this

Thirtieth Day of November, 1999

*Attest:*

*Attesting Officer*

Q. TODD DICKINSON

*Acting Commissioner of Patents and Trademarks*